US012325989B1

(12) United States Patent
Snyder et al.

(10) Patent No.: US 12,325,989 B1
(45) Date of Patent: Jun. 10, 2025

(54) VACUUM BREAKER WATER CAPTURING DEVICE AND SHIELD

(71) Applicants: James Snyder, Ramona, CA (US); Mary Snyder, Ramona, CA (US)

(72) Inventors: James Snyder, Ramona, CA (US); Mary Snyder, Ramona, CA (US)

( * ) Notice: Subject to any disclaimer, the term of this patent is extended or adjusted under 35 U.S.C. 154(b) by 0 days.

(21) Appl. No.: 18/979,463

(22) Filed: Dec. 12, 2024

Related U.S. Application Data

(60) Provisional application No. 63/609,283, filed on Dec. 12, 2023.

(51) Int. Cl.
*E03C 1/10* (2006.01)

(52) U.S. Cl.
CPC ..... *E03C 1/108* (2013.01)

(58) Field of Classification Search
CPC ..... E03C 1/108
See application file for complete search history.

(56) References Cited

U.S. PATENT DOCUMENTS

| | | | | |
|---|---|---|---|---|
| 3,183,924 | A * | 5/1965 | Duchin | E03C 1/108 251/333 |
| 3,862,640 | A * | 1/1975 | Hechler, IV | E03C 1/108 137/1 |
| 5,176,165 | A * | 1/1993 | Traylor | E03C 1/12 137/515 |
| 5,392,805 | A * | 2/1995 | Chrysler | E03B 9/14 137/218 |
| 5,651,388 | A * | 7/1997 | Farnan, Jr. | E03C 1/08 40/671 |
| 5,845,670 | A * | 12/1998 | Life | E03C 1/023 137/119.05 |
| 2010/0132821 | A1* | 6/2010 | Threlkeld | E03B 7/12 137/614.2 |
| 2016/0102446 | A1* | 4/2016 | Brucker | E03B 3/03 137/15.01 |
| 2018/0202133 | A1* | 7/2018 | Walcome | E03C 1/108 |
| 2020/0282379 | A1* | 9/2020 | Mulet | B01J 20/28011 |
| 2020/0325662 | A1* | 10/2020 | Seitter | E03B 9/027 |
| 2020/0325664 | A1* | 10/2020 | Brady | E03B 9/027 |

* cited by examiner

*Primary Examiner* — Kevin R Barss
(74) *Attorney, Agent, or Firm* — Donn K. Harms

(57) ABSTRACT

A water capturing device is provided having a body which is operatively engageable with a spigot assembly having a spigot with a vacuum breaker thereon. An axial passage of the body of the device, when in operative engagement, collects and redirects water expelled from the vacuum breaker downward out a discharge opening where it may be collected and used elsewhere.

12 Claims, 7 Drawing Sheets

VACUUM BREAKER WATER CAPTURING DEVICE AND SHIELD

This application claims priority to U.S. Provisional Patent Application Ser. No. 63/609,283 filed on Dec. 12, 2023.

FIELD OF THE INVENTION

The disclosed device relates to water supplies for homes and businesses. More particularly, it relates to a combination water capturing and water shield device which surrounds a vacuum breaker connected to a spigot and provides for the collection of otherwise wasted water to a container or the like.

BACKGROUND OF THE INVENTION

In modern water distribution systems, such as those provided by cities and counties to residents, water is normally maintained at a significant pressure to enable water to flow from the tap, shower, or other fixture in a home or business. While this pressurized system works well in normal conditions, should system water pressure fail or be reduced, such as when a water main bursts, pipes freeze, or there is unexpectedly high demand on the water system, it can cause a significant pressure reduction within the water pipes. Such water in the system changing from a higher pressure to a reduced pressure in the pipes may allow or cause a back flow where contaminated water from the soil, from storage, from garden hoses or from other sources is drawn up into the system.

Modernly, most utilities providing water to homeowners and businesses have taken precautions to help eliminate such contamination of the water supply with non-potable water during such a back flow. To that end, where connections to the system, such as garden hoses, could be a source of such a fluid back flow, a vacuum breaker is required to be positioned between the spigot supplying the water from the system and the hose receiving the water supply.

In operation, the pressure of flowing water pushes out of a spigot and pushes upon a valve in the vacuum breaker open to allow flow therethrough. When the water is turned off, the water pressure flowing from the spigot decreases and the valve within the vacuum breaker closes. While this keeps water from a hose or the like from seeping back into the system through the spigot, in most instances, the water which would be drawn into the system is instead ejected through openings in the sidewall of the vacuum breaker. This ejection of water can in some instances be sufficient to spray bystanders and in all instances is a waste of good water. Further, with the rising popularity of collapsible hoses a significant amount of water is being wasted after the user closes the spigot. The elastic nature of such hoses causes a compression once water pressure ceases and this forces gallons of water still within the hose to exit from the vacuum breaker and onto the ground.

In this respect, before explaining at least one embodiment of the water capturing device herein, it is to be understood that the water capturing invention for such vacuum breakers disclosed is not limited in its application to the details of construction and to the arrangement of the components set forth in the following description or illustrated in the drawings nor the steps outlined in the specification.

Also, it is to be understood that the phraseology and terminology employed herein are for the purpose of description and should not be regarded as limiting in any manner. As such, those skilled in the art will appreciate that the conception upon which this disclosure is based may readily be utilized as a basis for designing other methods and systems for carrying out the several purposes of the water capturing device for use in combination with a vacuum breaker as disclosed herein. It is important, therefore, that the claims be regarded as including such equivalent construction insofar as they do not depart from the spirit and scope of the present invention.

OBJECTS OF THE INVENTION

An object of this invention is the provision of a water capturing device which is operatively engageable to surround the exterior of a vacuum breaker to thereby allow for the capture of expelled water from the vacuum breaker.

It is another object of this invention to provide such a water capturing device which enables the user to capture normally wasted water and to use it elsewhere.

It is yet another object of this invention to provide a shield from water spray ejected from a vacuum breaker to keep bystanders from getting wet.

These, together with other objects and advantages of the disclosed water capturing device for a vacuum breaker herein which will become subsequently apparent to those skilled in the art, reside in the details of the construction and method herein as more fully hereinafter described and claimed, reference being had to the accompanying drawings forming a part thereof, wherein like numerals refer to like parts throughout.

SUMMARY OF THE INVENTION

The device herein disclosed provides a solution to the wasted water which occurs from the conventional operation of vacuum breakers where water is vented from the vacuum breaker and vented through an annular circumferential side opening. It also provides a shield from over spray exiting conventional vacuum breakers.

In operation of such a vacuum breaker, as noted above, once the flow of pressurized water from the spigot becomes too low or ceases, suctioning back flow is prevented by the vacuum breaker by blocking the back flow of water and venting at least a portion of it from the side opening where formed. Conventionally, the vented water sprays from the annular openings and is wasted when falling to the ground. Where this occurs many times at a single household and thousands of times a day throughout a city or county, a significant amount of water is wasted. Further collapsible hoses are employed the wasted water can be many gallons each time the hose spigot is closed.

The device herein features a body which is configured to form an engagement to surround a conventional vacuum breaker commonly used in between a water spigot and a hose, such as a garden hose. The device in all modes may be removably engaged to a coupling with the faucet or spigot or the vacuum breaker or the hose, to place an interior sidewall of the device surrounding the vacuum breaker.

The body of the device herein could be provided in a configuration where it is attached to the vacuum breaker itself on an OEM configuration where it is formed as part of a vacuum breaker. However, with the large number of existing vacuum breakers already in use nationwide, the engageable configuration of the device herein is disclosed in detail.

In all modes of the device, the body of the device is preferred in a configuration where it will surround the exterior circumference of a conventional vacuum breaker employed between a spigot and hose. Where the hose is removed, the body could be configured with a central passage communicating between sidewalls of the body. The sidewalls may direct the water from the vacuum breaker downward to a container or the sidewall of the device itself may be configured to form a reservoir area within an interior of the body. In this mode, a polymeric grommet or O-ring will be positioned within each opening in each sidewall and will engage around the outside circumference of the existing vacuum breaker. Engagement would be by sliding the two openings over the outside of the vacuum breaker. This will position the reservoir of the body to surround and capture water expelled by the vacuum breaker which can be routed to a drain tube where the user can collect it for watering uses.

In a mode of the device where the body is engageable to a vacuum breaker already having a hose connected thereto, the body is formed of two halves which engage to each other and position each of the openings surrounded by the circumferential surface of the vacuum breaker. The two halves of the body in this mode can simply engage using connectors or in an easy to install mode, the body has a clamshell configuration where it is hinged on one side and has a connector on the opposite side to hold the two halves together and form the interior reservoir. While the shape herein is shown as circular, other shapes may also be employed so long as the body of the device will operatively engage to surround the exterior of the vacuum breaker and collect water within the reservoir.

It should be noted that the interior reservoir should not be sealed in engagement with the exterior of the vacuum breaker in a manner that seals it from exterior air since that may render the vacuum breaker inoperable. It is therefor preferred that the body of the device engaged around the vacuum breaker does not form an air tight seal.

In another mode of the device, it is formed in two components, wherein a first component or a mount end is engageable to a position surrounding all or a portion of the vacuum breaker. A second component or tube portion is engageable with the first component to provide an elongated axial passage which will direct water exiting the vacuum breaker in a downward channeled flow, so it may be captured by a container placed thereunder and used elsewhere.

In operation, when the user turns off the spigot or when the water pressure in the spigot drops below operational pressure, the vacuum breaker will stop any water back flow and will route any water in this operation into the reservoir of the engaged body of the device. In the mode of the device with a formed reservoir a drain tube is preferably engaged to the body in a manner to communicate water captured in the reservoir to a collection container. In the mode of the device having a passage to channel captured water downward the container may simply be placed below the hose hookup.

With respect to the above description then, it is to be realized that the dimensional relationships for the components of water capturing device for employment in combination with a water spigot having a vacuum breaker, may also include variations in size, materials, shape, form, function and manner of operation, manner of formation, assembly and use, which are deemed readily apparent and obvious to one skilled in the art subsequent to their review of this specification. Therefore, the foregoing summary and following description are considered as illustrative only of the principles of the water capturing device invention to provide for collection of otherwise wasted water.

Additionally, since numerous equivalent modifications and changes will readily occur to those skilled in the art subsequent to their review of this disclosure, it is not desired to limit the invention to the exact construction and operation and steps of formation and employment shown and described, and accordingly, all suitable modifications and equivalents which may be resorted to, are considered to fall within the scope of the invention.

BRIEF DESCRIPTION OF THE DRAWINGS

The accompanying drawings, which are incorporated herein and form a part of the specification, illustrate some but not the only or exclusive examples of embodiments of water capturing device for engagement to a vacuum breaker herein. It is intended that the embodiments and figures disclosed herein are to be considered illustrative of preferred modes of the device and the system rather than limiting.

DETAILED DESCRIPTION OF THE INVENTION

Figure 1:
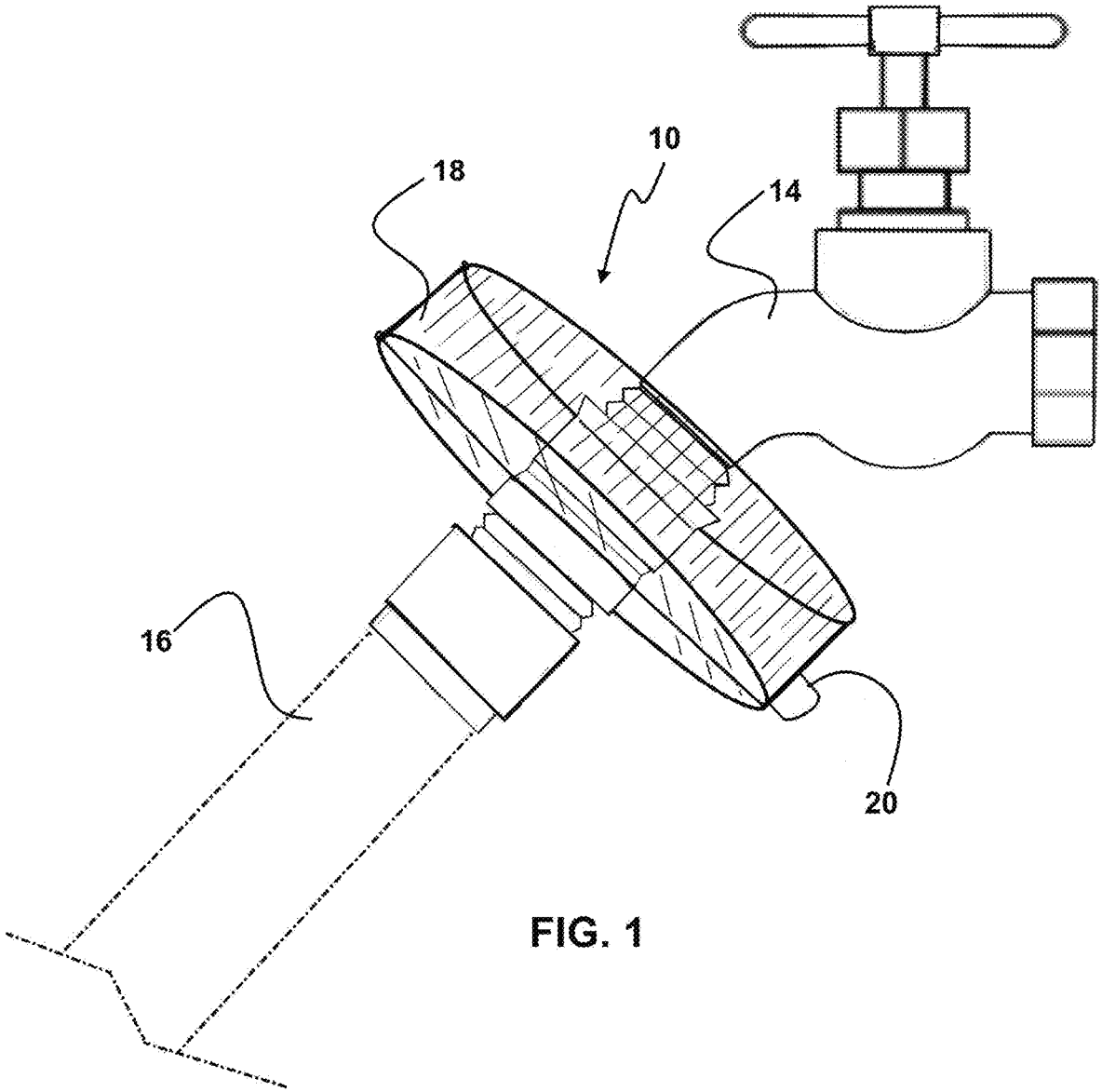
FIG. 1 depicts a mode of the water capturing device herein shown in operative engagement to surround the exterior of a vacuum breaker with a reservoir formed by the surrounding body of the device to capture water expelled by the vacuum breaker which may be routed through a tube for use elsewhere.

Referring now to the drawings in FIGS. 1-8, wherein similar parts of the water capturing device for use in operative positioning surrounding a vacuum breaker are identified by like reference numerals:

There is seen in FIG. 1 the water capturing device 10 herein in operative engagement with or surrounding a vacuum breaker 12, such as those engaged between a spigot 14 and hose 16. By operative engagement of the device 10 or 11 herein is meant that the device 10 or 11, is configured to be coupled to a water spigot assembly which includes the spigot 14 with a vacuum breaker 12 connected thereto, so as to locate the device 10 or 11 with the body surrounding the vacuum breaker 12 in a positioning which redirects any flow of water 22 therefrom downward to an exit opening or reservoir so the water may be collected. In the mode of the device of FIGS. 1-3, the reservoir formed within the interior of the body 18 of the device 10 is positioned to capture substantially all of the water emitted by the operation of the vacuum breaker 12. The body 18 is operatively engaged by a contact engagement of openings in opposing sides of the body 18 with the exterior of the vacuum breaker 12, but other connections of the body 18 to locate the reservoir in a position to capture the emitted water are employable and anticipated.

Also shown in FIG. 1 is a tube 20 having an interior passage which communicates with the reservoir within the interior of the body 18 of the device 10. This allows the user to place a collection container below to collect captured water or to engage a hose to direct captured water to an alternative location.

Figure 2:
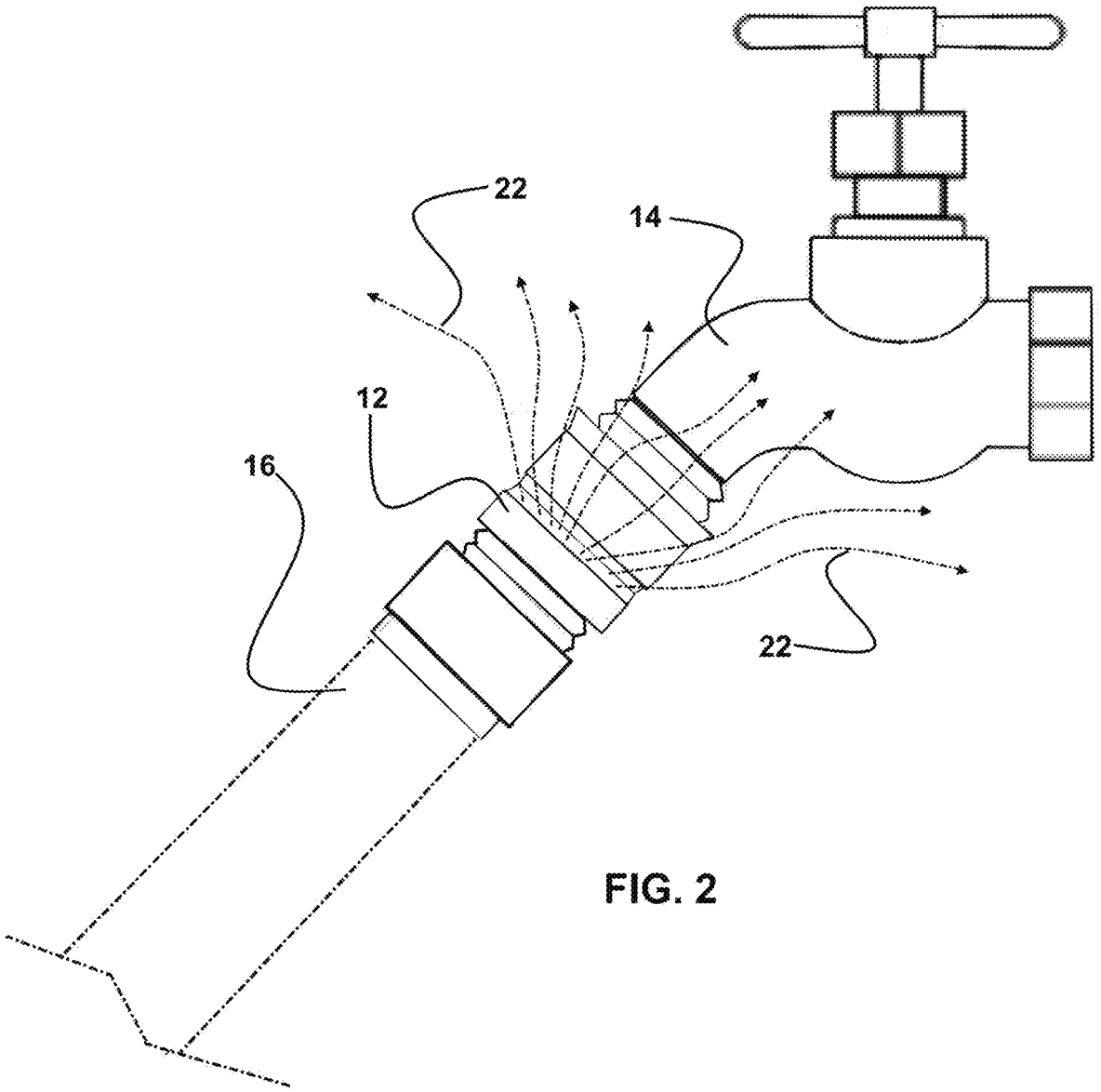
FIG. 2 depicts a view of conventional prior art where the vacuum breaker engaged between a hose and spigot will eject water during operation from side surfaces, such as through a series of radially positioned annular openings.

Shown in the depiction in FIG. 2 is a view of the conventional employment of a vacuum breaker 12. As shown, the vacuum breaker 12 is engaged to the threads of a spigot 14 and provides a threaded connection for a hose 16 on the opposite end. As noted in conventional operation, water 22 is expelled from the vacuum breaker 12 and is wasted.

In some cases, the water, so expelled, can be significant and reach a distance where bystanders or their lower body can be contacted by the water 12 in a surprise dousing. The device 10 herein, as noted, alleviates the waste of the expelled water 22.

Figure 3:
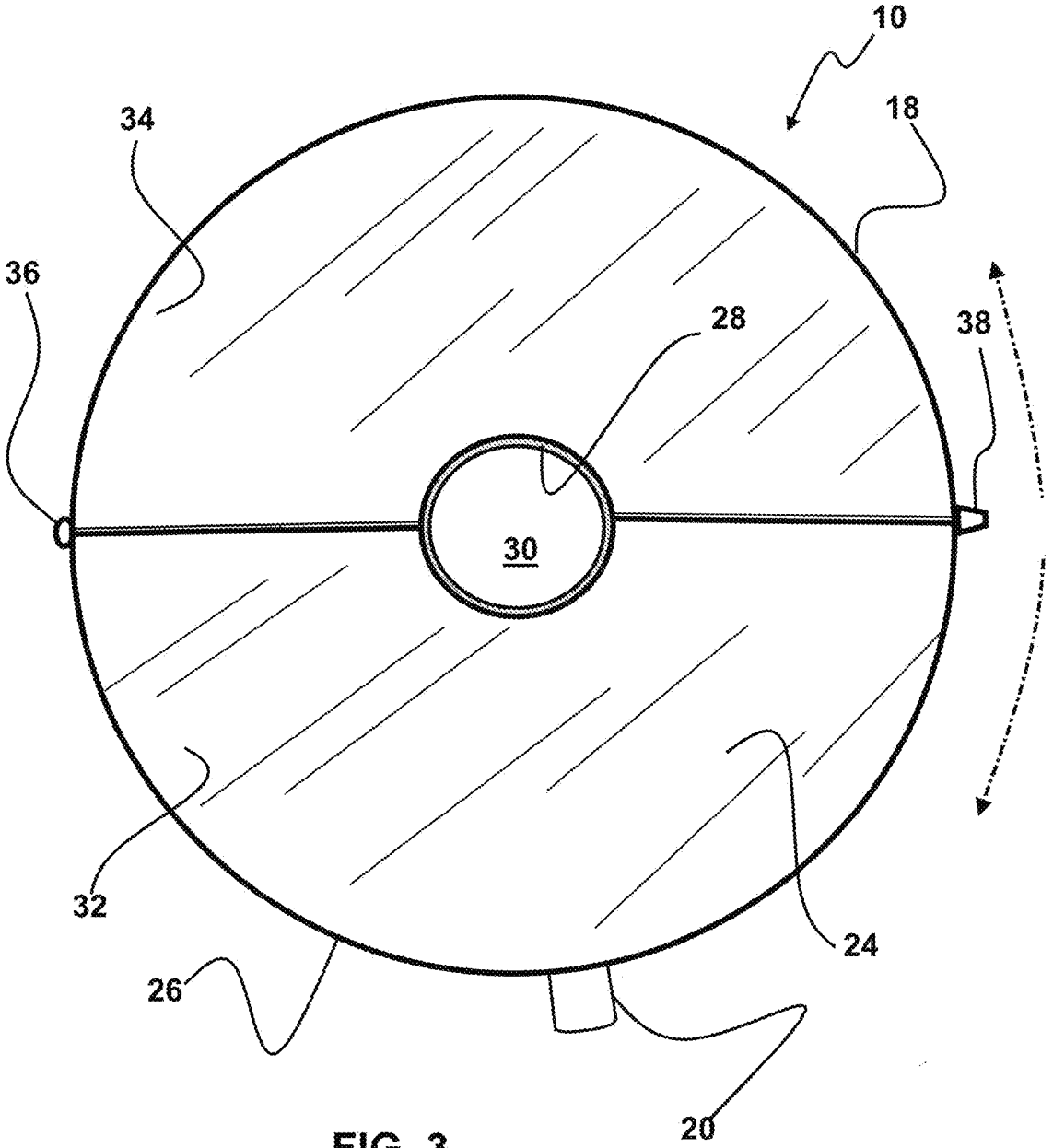
FIG. 3 depicts an end view of the water capturing device of FIG. 1 herein showing one of two openings formed in opposing sidewalls of the body of the device which are configured to engage around the exterior circumference of the vacuum breaker or adjacent surface, so water emitted from the vacuum breaker is captured and redirected to a reservoir.

In the depiction of FIG. 3 is shown the body 18 of the device 10 herein showing one side of the body 18 and a first sidewall 24 extending to an endwall 26 of the body 18. A first opening 28 is formed into the first sidewall 24 and is sized for sealed positioning with the exterior of the vacuum breaker 12 or with surfaces adjacent thereto which will allow for operative engagement of the body 18 to surround vacuum breaker 12.

The body 18 of FIG. 3 has a second side wall opposite the first sidewall 24 and a second opening aligned with and opposite the first opening 28 which are not shown. While the body 18 in FIG. 3 is shown formed of two half portions, as noted, it can be formed in a single unitary structure so long as the first opening 28 and an opposite second opening are configured to slide the body to a mounted operative engagement with a vacuum breaker 12.

In the mode shown, a first half portion 32 of the body is engaged with a second half portion 34 of the body 18 in a hinged or clamshell type engagement by a hinge 36. A connector 38 will hold the two half portions, removably engaged, so that the body 18 can be easily operatively engaged to surround a vacuum breaker 12 which already has a hose 16 extending in an engagement thereto.

The first opening 28 and opposite second opening may include a polymeric edge or other edge which will form a compressive connection and hold the body in position. The placement of the tube 20 at a bottom or lower end of the body 18 will tend to draw that end of the body 18 to a lower position where water in the interior cavity 30 reservoir will flow easily downward. This placement also gives the user a viewable preferred mounting position for the device 10 which may be depicted in instructions.

In this clamshell version of the device 10, the body 18 is easily positioned to operative engagement with the vacuum breaker 12 and easily disengaged, if needed. Once engaged, the connector 38 holds the two half portions together with the interior cavity reservoir located to capture expelled water. The engagement of this hinged body is easy in locations with a hose 16 already connected to the vacuum breaker 12 or where no hose 16 is connected.

FIGS. 4-8 show another preferred configuration of the water capturing device 11 herein which is also configured for operative engagement with the water spigot assembly which includes the spigot 14 with a vacuum breaker 12 connected thereto, with the sidewall 25 of the body 42 surrounding the vacuum breaker 12 in a position which redirects the water 22 dispersed from the vacuum breaker 12 for collection. While the device 11 may be formed in a unitary structure, appearing substantially as in FIG. 5, it was found that for easier positioning of the device 11 to an operative engagement, the body 42 is formed with a mount end 44 at a first end of the body 42 which is engageable with a tube portion 46. This allows a method of use of the device 11 by coupling the mount end 44 coupled to the spigot 14 or vacuum breaker 12 first to provide easy access to engage the hose 16 for subsequent connection to the spigot 14. In this method, the mount end is coupled to the vacuum breaker or spigot first, and the tube portion 46 is slid upon the connection end of a hose 16. Next, the hose is connected to the spigot 14 and finally the tube portion is engaged to the mount end 44. Thereafter, water 22 exiting the tube portion 46 is collected for use in a container 58. Where the body 11 is formed as a unitary structure, the body 11 would need to be slid on the hose 16 before it is operatively engaged to the spigot assembly, and once the hose 16 is connected to the spigot 14, the body 42 would be operatively engaged to the spigot assembly.

An aperture 48 in the mount end 44 is sized to slide over the exterior of vacuum breaker 12. The mount end 44 may then be coupled to either the spigot 14 or the vacuum breaker 12 or the hose 16 in a manner that, once the tube portion 46 is connected to the mount end 44 the body 42, is in the proper operative engagement to redirect the water 22.

With the tube portion 46 connected to the mount end 44 the body 42 has an axial passage 50 communicating between the aperture 48 at the mount end 44 and a discharge opening 52 at an opposite end of the body 42. As noted above, the body 42 may be formed in a unitary structure with the tube portion 46 and mount end 44 in a single unit. However, separating them into two components makes the device 11 easier to position to the operative engagement. To hold the device 11 in the operative engagement, a fastener 54 adapted to that task may be employed, or the aperture 48 may be formed to engage in a friction fit upon the vacuum breaker 12 or the spigot 14 or the connecting end of the hose 16.

Figure 4:
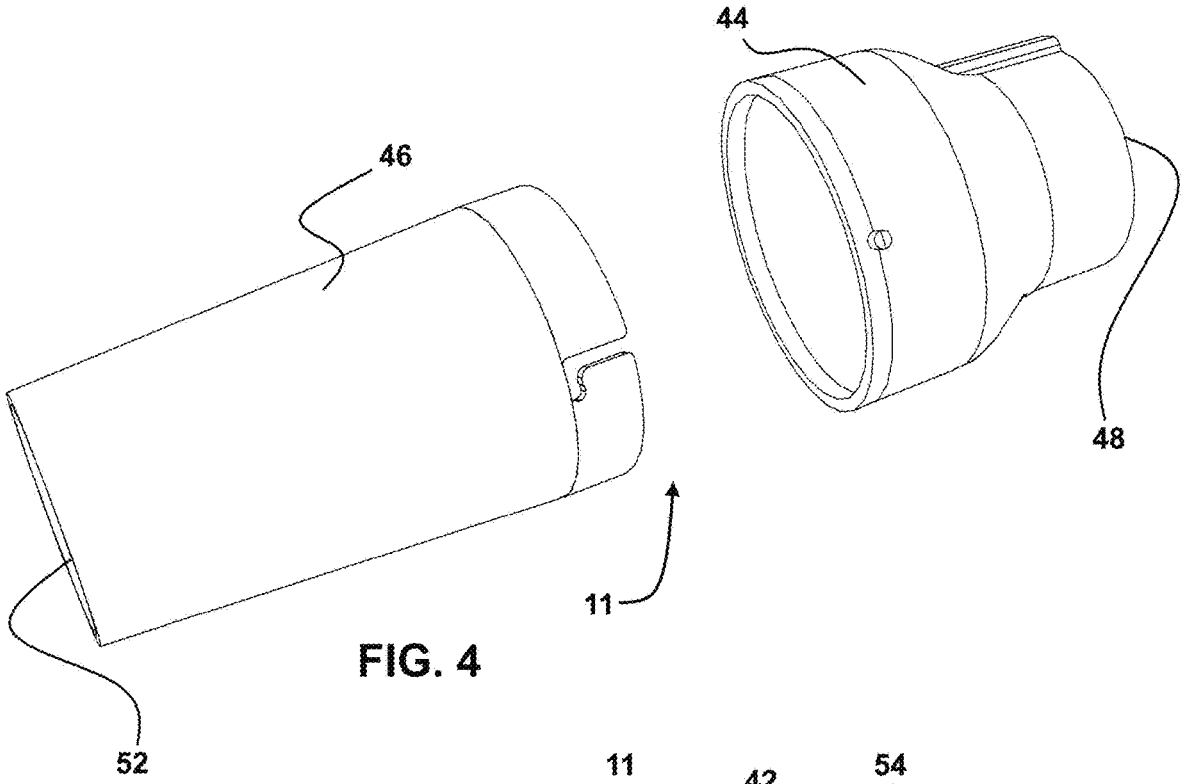
FIG. 4 shows another configuration of the water capturing device herein formed with a mount at a first end and an engageable tube which extends from a connection with the mount.
Figure 5:
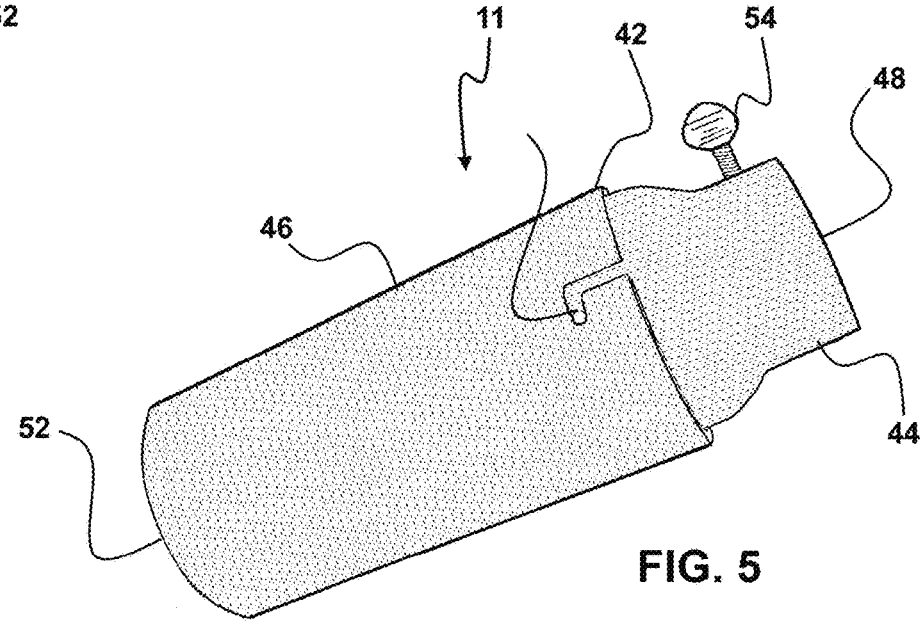
FIG. 5 depicts the device herein as in FIG. 4 showing the mount with the tube portion engaged thereto.

In FIG. 5 is shown the device 11 herein, as in FIG. 4, wherein the mount end 44 is connected to the tube portion 46 using a co-operative connection 56 therebetween or as noted forming the device 11 as a unitary structure. As shown the aperture 48 communicates with one end of the axial passage 50 (FIG. 7) and the discharge opening 52 communicates with the opposite end of the axial passage 50.

Figure 6:
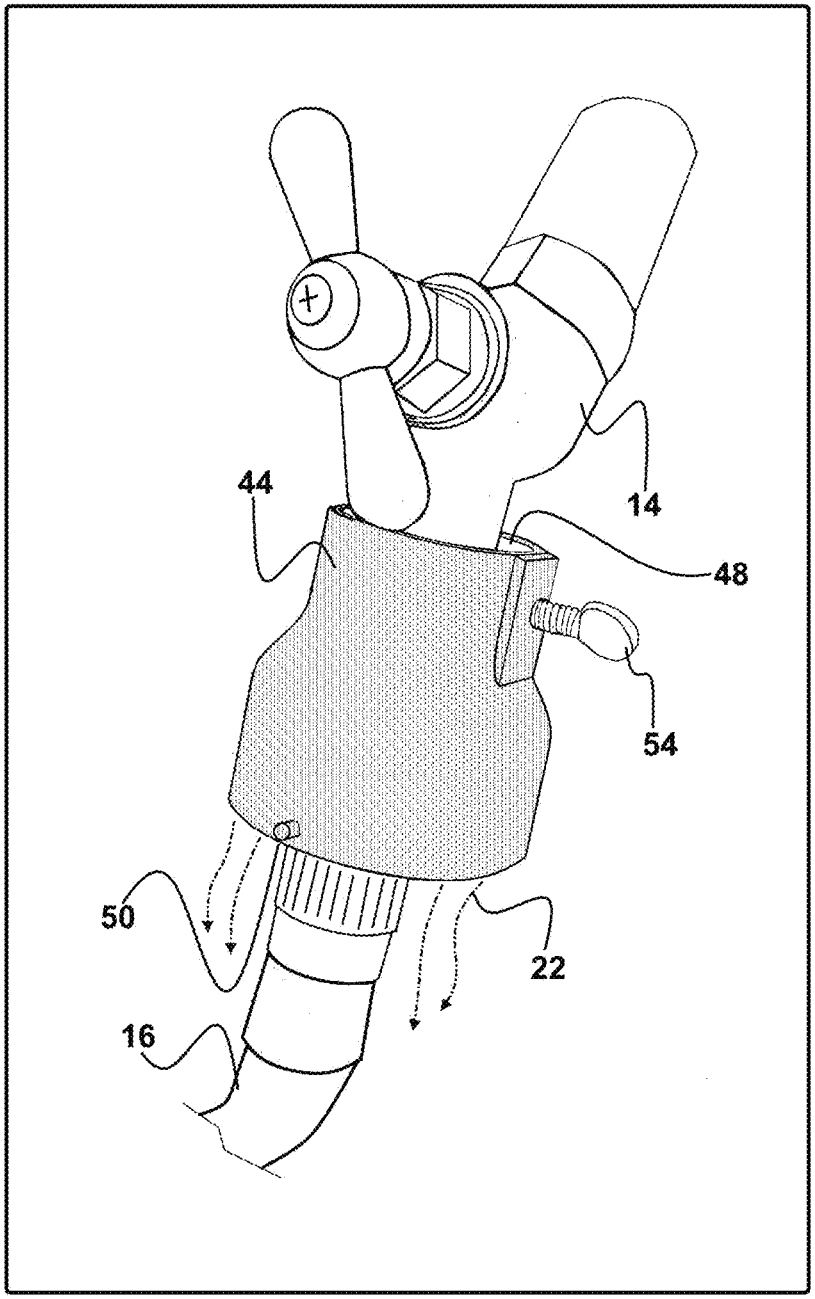
FIG. 6 depicts an operative engagement of a first end of the device to a spigot or vacuum breaker using a connector.

Shown in FIG. 6 is a coupling of the mount end 44 to a spigot 14 or to a vacuum breaker 12 engaged therewith. As shown, the aperture 48 allows for translating the mount end 44 to a position wherein it surrounds the area where the vacuum breaker 12 engages the spigot 14 in conventional hose spigots 14.

Figure 7:
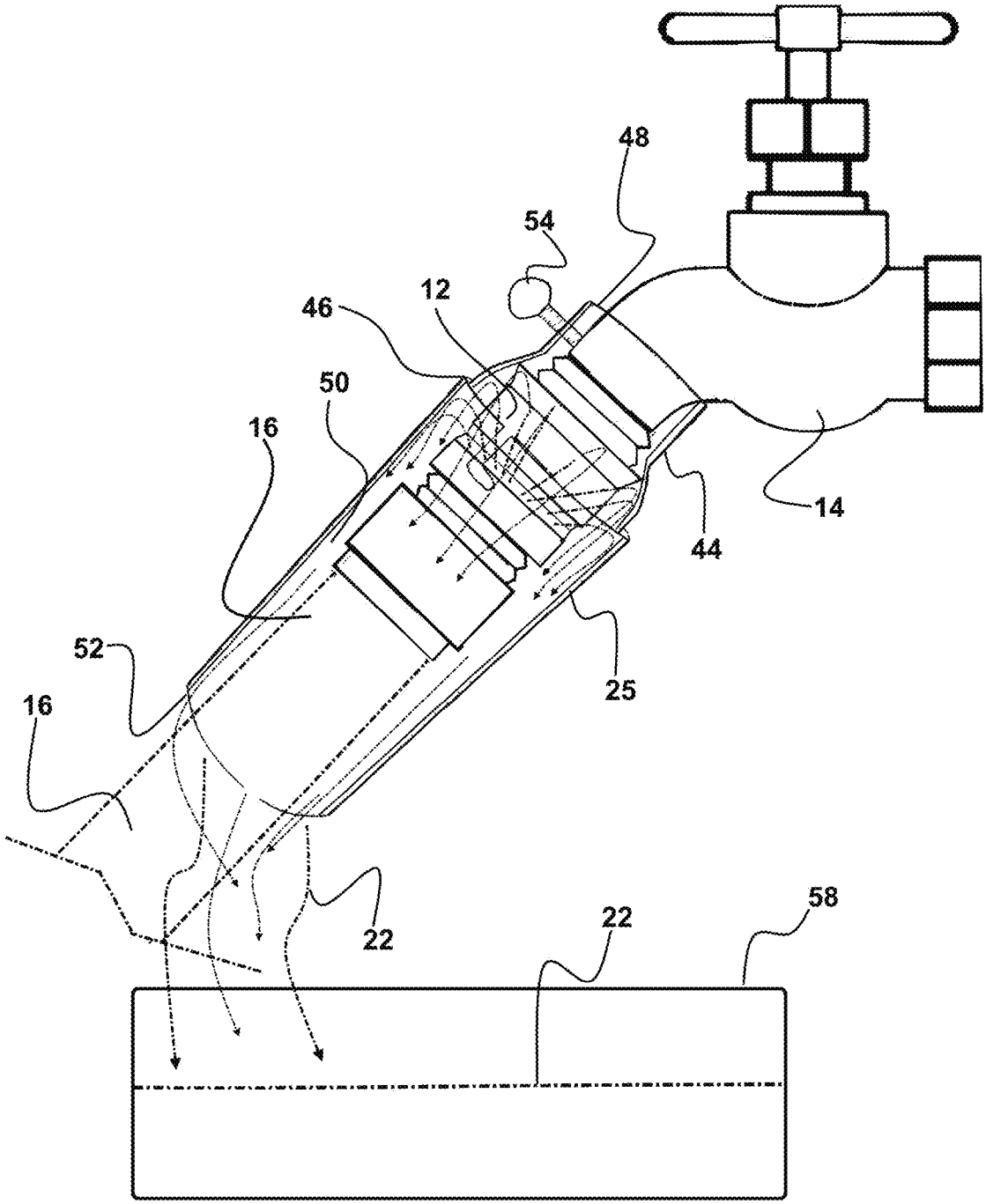
FIG. 7 shows the device as in FIGS. 4 and 5 with a transparent sidewall to the device coupled to a water spigot at the spigot and channeling water expelled from the vacuum breaker trough an axial passage so it may be collected in a container.
Figure 8:
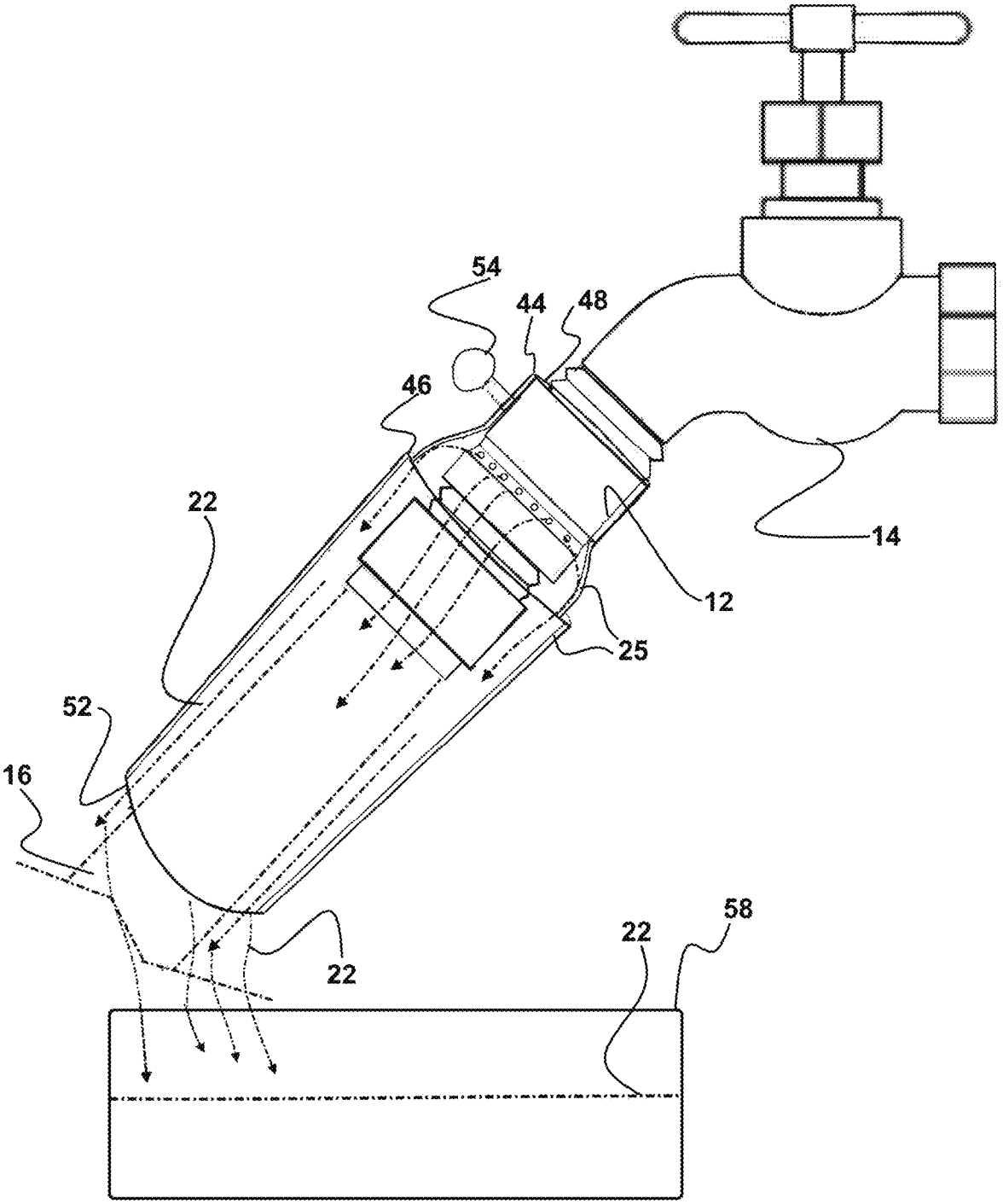
FIG. 8 depicts the device in a configuration similar to FIG. 7 but showing the device coupled to the spigot at the vacuum breaker.

In FIG. 7 is depicted the device 11 as in FIGS. 4 and 5 coupled to the spigot 14 but with a transparent sidewall 25 of the assembled device 11. As shown, a capturing and channeling of water 22 expelled from the vacuum breaker 12 travels through the axial passage 50 and exits at the discharge opening 52. The water 22, so discharged, may then be collected in a container 58 or otherwise redirected or collected for use such as for watering plants or other purposes. A similar depiction is shown in FIG. 8 where the device 11 is coupled to the vacuum breaker 12. As noted, a fastener 54 may be employed or the aperture 48 may be sided for a frictional fit, or other means for forming the coupling to the vacuum breaker 12 or the spigot 14 or hose 16 may be employed which holds the device 11 to an operative engagement.

As noted above, while the presently disclosed water capturing device for use in combination with a vacuum breaker has been described herein with reference to particular embodiments thereof and steps in the method of employment of the modes thereof, a latitude of modifications, various changes and substitutions are intended in the foregoing disclosures. It will be appreciated that in some instance some features or steps in configuration and employment of the water capturing invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. Any such abstract if appended hereto is neither intended to define the invention of the application, which is measured by the claims, nor is it intended to be limiting, as to the scope of the invention in any way.

What is claimed is:

1. A water capturing apparatus comprising:

a body having a sidewall extending between an aperture at a mount end thereof and a discharge opening at an opposite end thereof;

an axial passage communicating between said aperture and said discharge opening; and said body configured for operative engagement with a spigot assembly having a spigot with a vacuum breaker thereon in a position wherein water discharged from said vacuum breaker is redirected through said axial passage to an exit from said discharge opening.

2. The water capturing apparatus of claim 1, additionally comprising:

said mount end being in a removable engagement with a tube portion at a first end of said tube portion opposite said discharge opening located at a second end of said tube portion;

an axial passage running through said mount end and said tube portion; and whereby said mount end is positionable to said operative engagement with said spigot assembly prior to said removable engagement of said tube portion.

3. The water capturing apparatus of claim 2, additionally comprising:

said operative engagement having a coupling of an interior surface of said aperture around an external circumferential surface of said vacuum breaker.

4. The water capturing apparatus of claim 3, additionally comprising:

said discharge opening positioned below said vacuum breaker with said body in said operative engagement, whereby said water flows downward through said axial passage.

5. The water capturing apparatus of claim 2, additionally comprising:

said operative engagement having a coupling of an interior surface of said aperture around an external surface of said spigot.

6. The water capturing apparatus of claim 5, additionally comprising:

said discharge opening positioned below said vacuum breaker with said body in said operative engagement, whereby said water flows downward through said axial passage.

7. The water capturing apparatus of claim 2, additionally comprising:

said discharge opening positioned below said vacuum breaker with said body in said operative engagement, whereby said water flows downward through said axial passage.

8. A method of employment of the device of claim 2 to capture water expelled from said vacuum breaker for use of said water comprising the steps of:

positioning said body to said operative engagement by first sliding said aperture of said mount end over said vacuum breaker and coupling it to said vacuum breaker or said spigot;

sliding said tube portion over a connection end of a hose;

connecting said hose to said spigot;

engaging said tube portion to said mount end; and capturing water exiting said discharge opening in a container.

9. The water capturing apparatus of claim 1, additionally comprising:

said operative engagement having a coupling of an interior surface of said aperture around an external circumferential surface of said vacuum breaker.

10. The water capturing apparatus of claim 1, additionally comprising:

said operative engagement having a coupling of an interior surface of said aperture around an external surface of said spigot.

11. The water capturing apparatus of claim 10, additionally comprising:

said discharge opening positioned below said vacuum breaker with said body in said operative engagement, whereby said water flows downward through said axial passage.

12. The water capturing apparatus of claim 1, additionally comprising:

said discharge opening positioned below said vacuum breaker with said body in said operative engagement, whereby said water flows downward through said axial passage.

* * * * *